US011603647B2

(12) United States Patent
Reese et al.

(10) Patent No.: US 11,603,647 B2
(45) Date of Patent: Mar. 14, 2023

(54) EXCAVATING TOOTH ASSEMBLY FOR EARTH-DIGGING EQUIPMENT

(71) Applicant: Pengo Corporation, Laurens, IA (US)

(72) Inventors: Justin Reese, Laurens, IA (US); Richard Willems, Parkville, MD (US)

(73) Assignee: Pengo Corporation, Laurens, IA (US)

( * ) Notice: Subject to any disclaimer, the term of this patent is extended or adjusted under 35 U.S.C. 154(b) by 400 days.

(21) Appl. No.: 16/735,090

(22) Filed: Jan. 6, 2020

(65) Prior Publication Data

US 2021/0207346 A1 Jul. 8, 2021

(51) Int. Cl.
*E02F 9/28* (2006.01)

(52) U.S. Cl.
CPC ..... *E02F 9/2825* (2013.01); *E02F 9/2833* (2013.01); *E02F 9/2858* (2013.01)

(58) Field of Classification Search
CPC ..... E02F 9/2816; E02F 9/2825; E02F 9/2833; E02F 9/2841; E02F 9/2858
See application file for complete search history.

(56) References Cited

U.S. PATENT DOCUMENTS 887,984 A * 5/1908 Thomas ..... E02F 9/2825 37/454
995,285 A 6/1911 Pemberton
1,544,222 A * 6/1925 Crosby ..... E02F 9/2825 37/455
1,808,311 A * 6/1931 Madonna ..... E02F 9/2825 37/456
2,256,488 A * 9/1941 Murtaugh ..... E02F 9/2825 D15/29
2,891,333 A * 6/1959 Lesher ..... E02F 9/2825 D15/29
2,934,842 A * 5/1960 Lesher ..... E02F 9/2825 37/456
3,426,459 A 2/1969 Petersen
3,496,658 A * 2/1970 Eyolfson ..... E02F 9/28 37/455

(Continued)

FOREIGN PATENT DOCUMENTS

CA 2 443 168 * 10/2004
WO 9525851 9/1995

OTHER PUBLICATIONS

Mar. 8, 2021 International Search Report and The Written Opinion—PCT/US2020/066777.

*Primary Examiner* — Gary S Hartmann
(74) *Attorney, Agent, or Firm* — Nyemaster Goode, P.C.

(57) ABSTRACT

A tooth assembly having an adapter, a tooth, and a pin. The adapter and the tooth each have a first portion and a second portion. The first portion of the adapter is adapted to be combined with an earth-digging implement. The second portion of the adapter is adapted to be combined with the tooth. The second portion of the adapter has an opening adapted to receive an engagement member extending from the second portion of the tooth. The first portion of the tooth is adapted to engage the material being displaced by the implement and the second portion is adapted to be combined with the adapter. The second portion of the tooth has an opening adapted to receive an engagement member extending from the second portion of the adapter. The pin is inserted through openings in both the adapter and the tooth to secure the two components together during operation.

14 Claims, 16 Drawing Sheets

(56) References Cited

U.S. PATENT DOCUMENTS

| | | | | |
|---|---|---|---|---|
| 5,417,518 | A | 5/1995 | Bierwith | |
| 5,802,752 | A | 9/1998 | Quarfordt | |
| 6,729,052 | B2 * | 5/2004 | Ollinger, IV | E02F 9/2841 403/374.4 |
| 10,214,879 | B2 | 2/2019 | Perez Soria et al. | |
| 10,927,529 | B2 * | 2/2021 | Cleophas | E02F 9/2866 |
| 2005/0011089 | A1 | 1/2005 | Duke | |
| 2008/0256832 | A1 | 10/2008 | Esti | |
| 2009/0000159 | A1 | 1/2009 | Breken | |
| 2012/0246982 | A1 * | 10/2012 | Bentley | E02F 9/2825 37/456 |
| 2012/0317768 | A1 | 12/2012 | Watanabe | |

* cited by examiner

EXCAVATING TOOTH ASSEMBLY FOR EARTH-DIGGING EQUIPMENT

BACKGROUND

The invention generally relates to a tooth assembly adapted to be combined with an earth-digging implement such as a bucket, blade, or the like, and more particularly to a tooth assembly having an adapter combined with a tooth wherein the tooth and adapter are secured together by a removable pin.

Certain types of earth-moving and excavating machinery are equipped with implements such as digging buckets or blades capable of digging or pushing rocks and dirt. These types of implements typically include a plurality of tooth assemblies combined with the leading edge of the implement to help penetrate the earth surface or gather rocks and dirt into or ahead of the implement. Each tooth assembly typically includes an adaptor rigidly attached to the implement by either welding or some form of mechanical fastener and a tooth. The adapter typically includes a protruding nose member received by an opening in the tooth. The chisel-like tooth of the assembly reduces the initial contact mass of the implement edge moving into the material being excavated by focusing the accumulated digging forces at the leading edge of each tooth, thereby maximizing the penetration efficiency of the excavating implement. The implements are subjected to severe use, often in hard material such as limestone, coal, or rock, which causes the teeth to wear or break over time. The adapter and tooth are typically connected by a removable pin so the tooth portion of the assembly can be removed and replaced in the event of wear or damage.

Conventional tooth assemblies are attended by certain disadvantages. One disadvantage is that the nose member protruding from the adapter into the tooth, being of relatively small cross-sectional area, can break. The nose is subjected to significant load as the tooth engages the rock/ground. Since the adapter is not easily removable from the implement, the resulting downtime to replace the adapter can be expensive.

Yet another disadvantage in conventional tooth assemblies is that the adapter and tooth do not fit tightly together. A loose fit means there is excessive movement between the two components as the tooth engages the rock/ground which can lead to breakage and failures.

Yet another disadvantage in conventional tooth assemblies is that the connection between the adapter and the tooth is not strong and sturdy. The components lack strength and rigidity in one or more directions. For example, some teeth may be strong when force is applied to the tooth in a first direction, but not when force is applied to the tooth in a second direction.

Another disadvantage of conventional tooth assemblies is that it can be difficult to remove the pin from the assembly to separate the old/worn tooth from the adapter. Additional tools, often a hammer and punch, are needed to punch the pin out of its seat. This is not convenient and the additional tools are not always readily available to the equipment operator thereby causing expensive downtime to the operation.

It is therefore an object of this invention to provide an improved tooth assembly overcoming some of the problems and shortcomings of devices and methods of the conventional tooth assemblies.

Another object of this invention is to provide an improved tooth assembly configured to improve the stability and strength of the connection between the adapter and the tooth.

Another object of this invention is to provide an improved tooth assembly wherein the adapter and tooth fit tightly together to reduce excessive movement between them.

Still another object of this invention is to provide an improved tooth assembly having, in one embodiment, a reduced number of parts.

Still another object of the invention is to provide a simplified and convenient means for removing the pin from the assembly when the user desires to replace the old/worn tooth with a new tooth.

These and other objects, features, and advantages of the invention will be apparent for the following description, taken in conjunction with the accompanying drawings.

SUMMARY

One aspect of the invention relates to a tooth assembly having an adapter, a tooth, and a pin. The adapter and the tooth each have a first portion and a second portion. The first portion of the adapter is adapted to be combined with an earth-digging implement, such as a bucket or blade. The second portion of the adapter is adapted to be combined with the tooth. The second portion of the adapter has an opening adapted to receive an engagement member extending from the second portion of the tooth. The first portion of the tooth is adapted to engage the material being displaced by the implement and the second portion is adapted to be combined with the adapter. The second portion of the tooth has an opening adapted to receive an engagement member extending from the second portion of the adapter. In this arrangement, a portion of each component (adapter and tooth) extends into an opening in the other component to help share the load between the components. The pin is inserted through apertures in both the adapter and the tooth to secure the two components together during operation. In some embodiments the pin is inserted downward into the top of the tooth so the pin is generally perpendicular to the digging surface of the tooth.

In some embodiments the engagement member extending from each component has a first surface extending in a first direction and a second surface extending in a second direction. The first direction and the second direction may be generally perpendicular, or they may be any other suitable angle from each other. Each engagement member is received by the opening in the other component so that the surfaces engage the corresponding surfaces in the other component. The mating of the components along surfaces extending in two directions helps provide stability for the connection between the tooth and the adapter regardless of the direction of force applied to the tooth during operation. In some embodiments the first surfaces extend in a generally horizontal direction and the second surfaces extend in a generally vertical direction.

In some embodiments the engagement member extending from the second portion of the tooth has a flat edge which may have a profile similar to a flat-blade screwdriver and the head of the pin has a recess or lip portion. In some embodiments the edge of the engagement member is tapered. The edge of the engagement member of a first tooth may be used to pry the pin out from its seat in a tooth assembly combined with a second tooth. In this manner a new/replacement tooth can be used to remove the pin from the old/worn tooth.

In some embodiments the pin has a shaft extending in a longitudinal direction away from a pin head. The pin head may have an asymmetrical shape such as a triangle or arrow adapted to be received by a corresponding shape recessed into the top surface of the tooth to help the user align the pin in the proper orientation. The pin may also have a compression member attached to the shaft by a compressible material such as volcanized rubber. The compression member has a first position wherein it extends a first distance from the shaft and a second (compressed) position wherein it extends a second distance from the shaft, wherein the first distance is greater than the second distance. The compression member includes a recessed portion adapted to engage a locking member of the assembly to help hold the pin in place during operation. The recessed portion serves as a detent to secure the pin in place against the locking member during normal working conditions. Applying force to the pin causes the compression member to move to its second (compressed) position thereby allowing the recessed portion to slide past the locking member so the pin can be removed from its seat within the assembly.

Another aspect of the invention relates to a method of using the tooth assembly described above. The method includes taking a tooth assembly having an adapter, a first tooth, and a pin, then securing the adapter to an implement by welding or inserting mechanical fasteners through both components. The first tooth is combined with the assembly so that the engagement member extending from the second portion of the adapter is inserted into the opening in the second end of the first tooth and the engagement member extending from the second portion of the first tooth is inserted into the opening in the second end of the adapter. Then, the pin is inserted into the aligned apertures in the first tooth and the adapter to secure the components together. When the first tooth becomes damaged or worn, a portion of the engagement member extending from a second tooth is inserted into the recessed opening in the first tooth and beneath a lip in the pin, then the second tooth is used to pry the pin from its seat within the assembly. The first tooth is removed from the adapter and the second tooth is combined with the adapter as described above.

DETAILED DESCRIPTION

Figure 1:
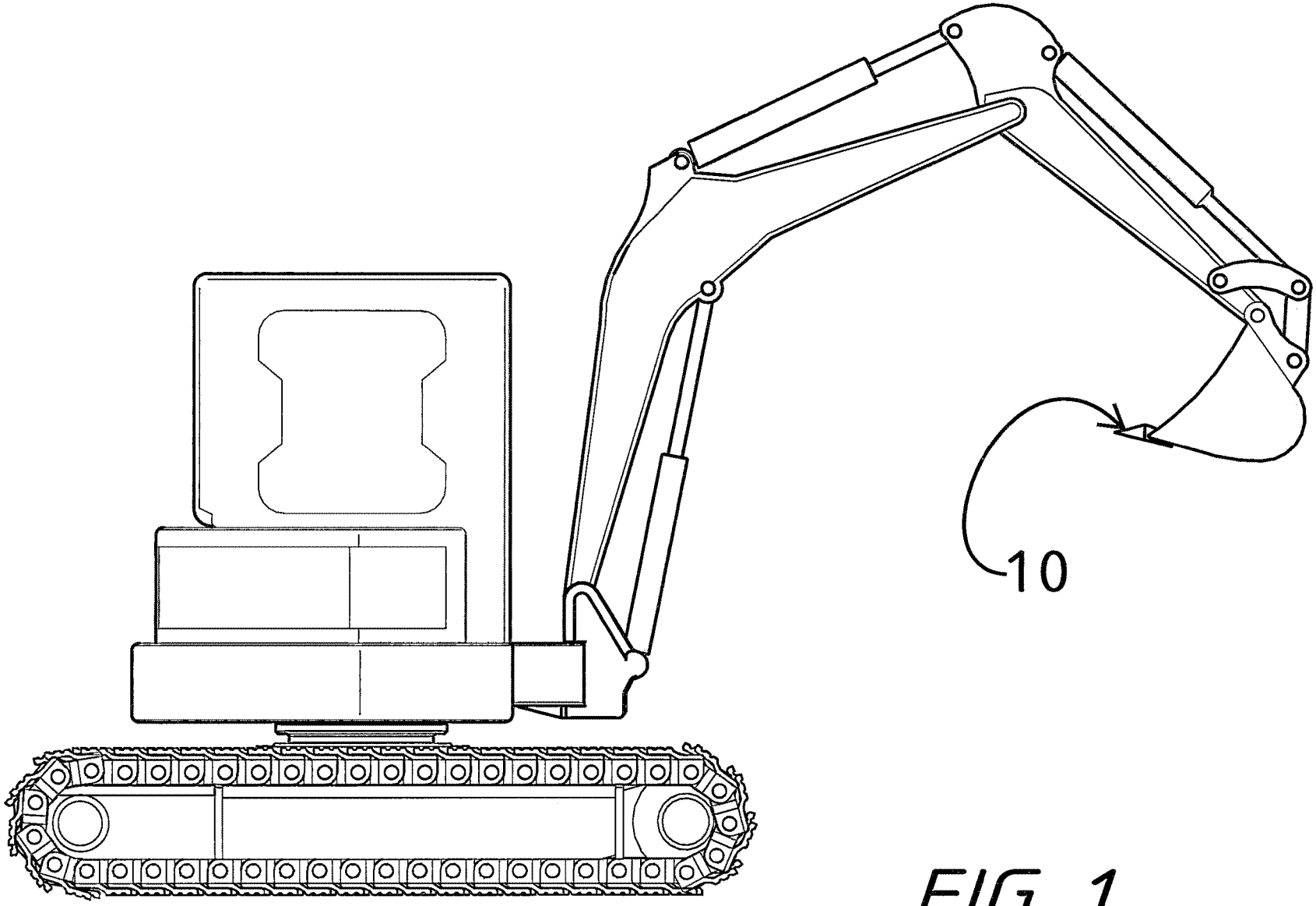
FIG. 1 is a side view of an exemplary earth-digging machine showing a tooth assembly combined with a bucket implement.

The invention generally relates to a tooth assembly 10 adapted to be combined with an earth-digging implement, such as a bucket, blade, or the like. FIG. 1 shows an exemplary tooth assembly 10 combined with the bucket implement of an excavator.

Figure 2:
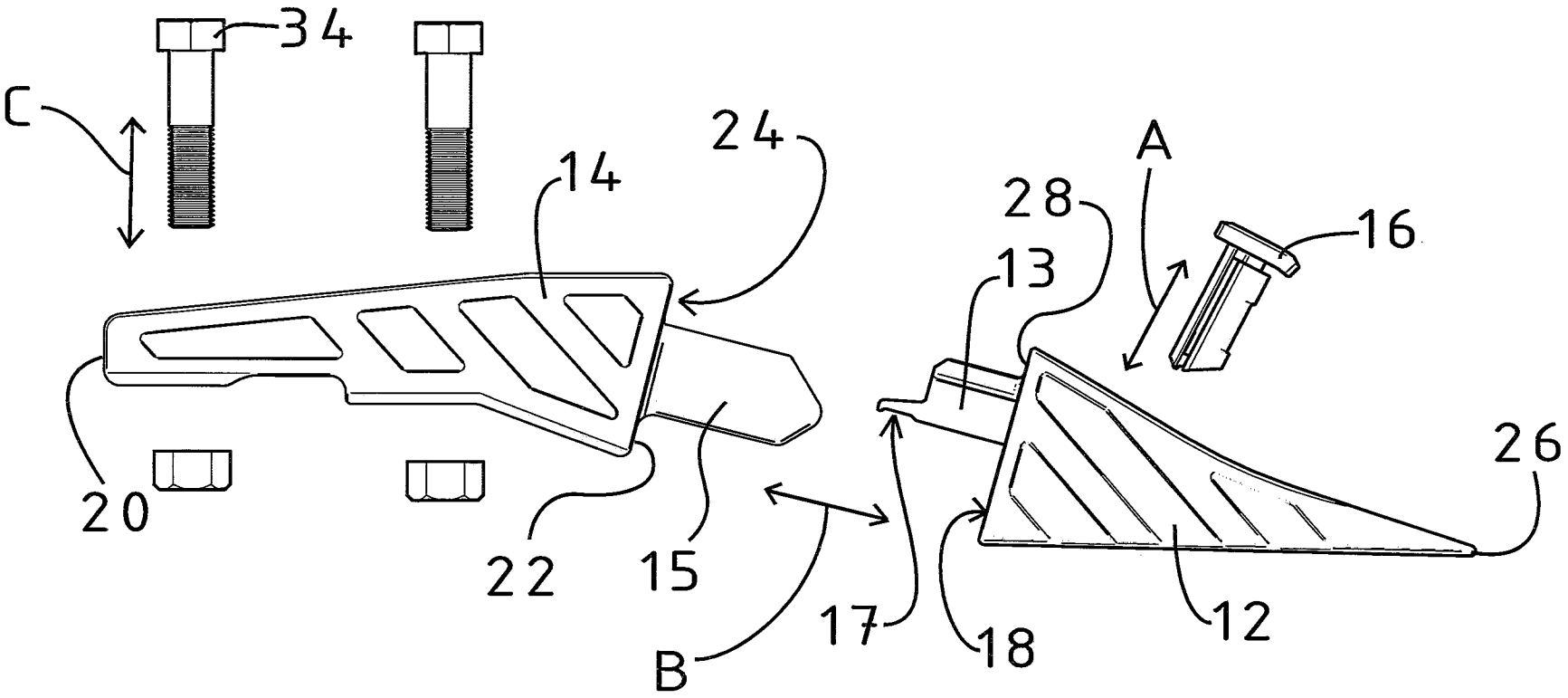
FIG. 2 is a side exploded view showing the adapter, tooth, and pin.
Figure 3:
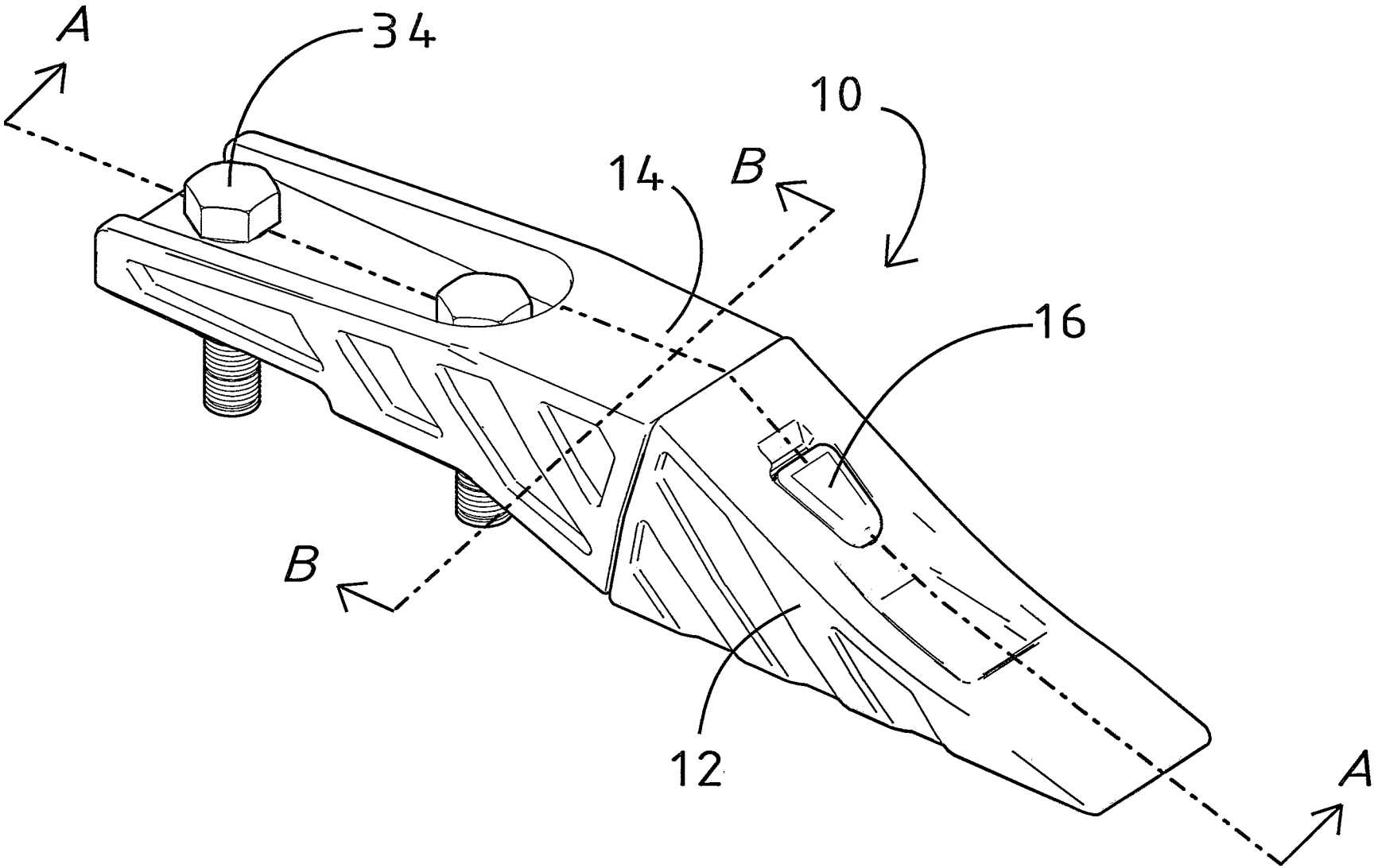
FIG. 3 is a perspective view of the assembled tooth assembly.

FIGS. 2 and 3 show the tooth assembly 10 having a tooth 12, an adapter 14, and a pin 16. As shown by the arrows A, B in FIG. 2, the tooth 12 may be selectively removed from the adapter 14 by first removing the pin 16 from its seated position where it extends through both the tooth 12 and the adapter 14, then separating the tooth 12 from the adapter 14. The tooth 12 can be removed from the adapter 14 and replaced with a new tooth 12 if it becomes damaged or worn due to continued engagement with rocks, dirt, and other materials. In use, the adapter 14 usually remains combined with the implement. When attaching a new tooth 12 to the adapter 14 the tooth 12 is combined with the adapter 14 then the pin 16 is inserted through both components 12, 14, as described in more detail below. FIG. 3 shows the tooth assembly 10 in its assembled configuration.

Figure 4:
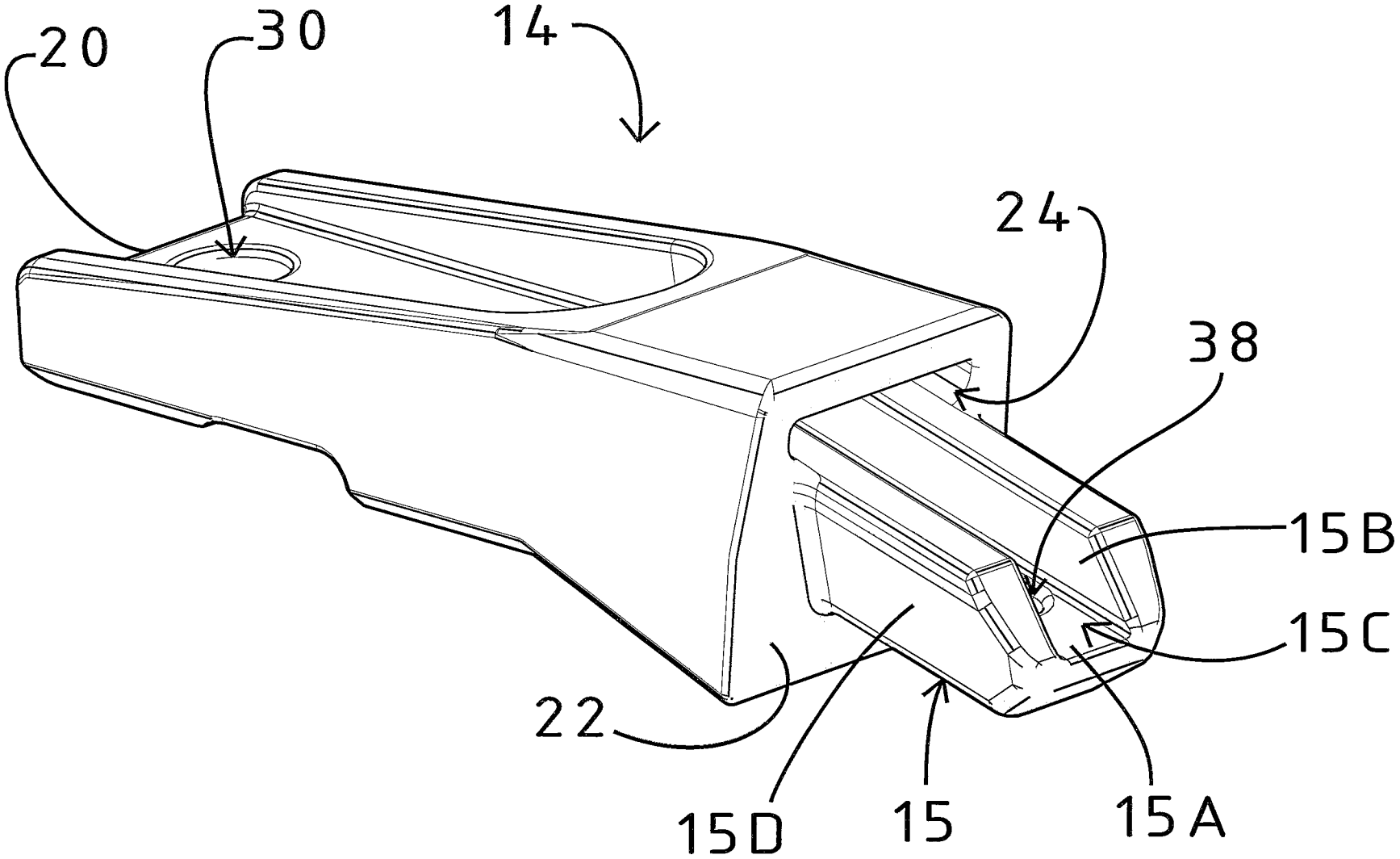
FIG. 4 is a perspective view of the adapter.
Figure 5:
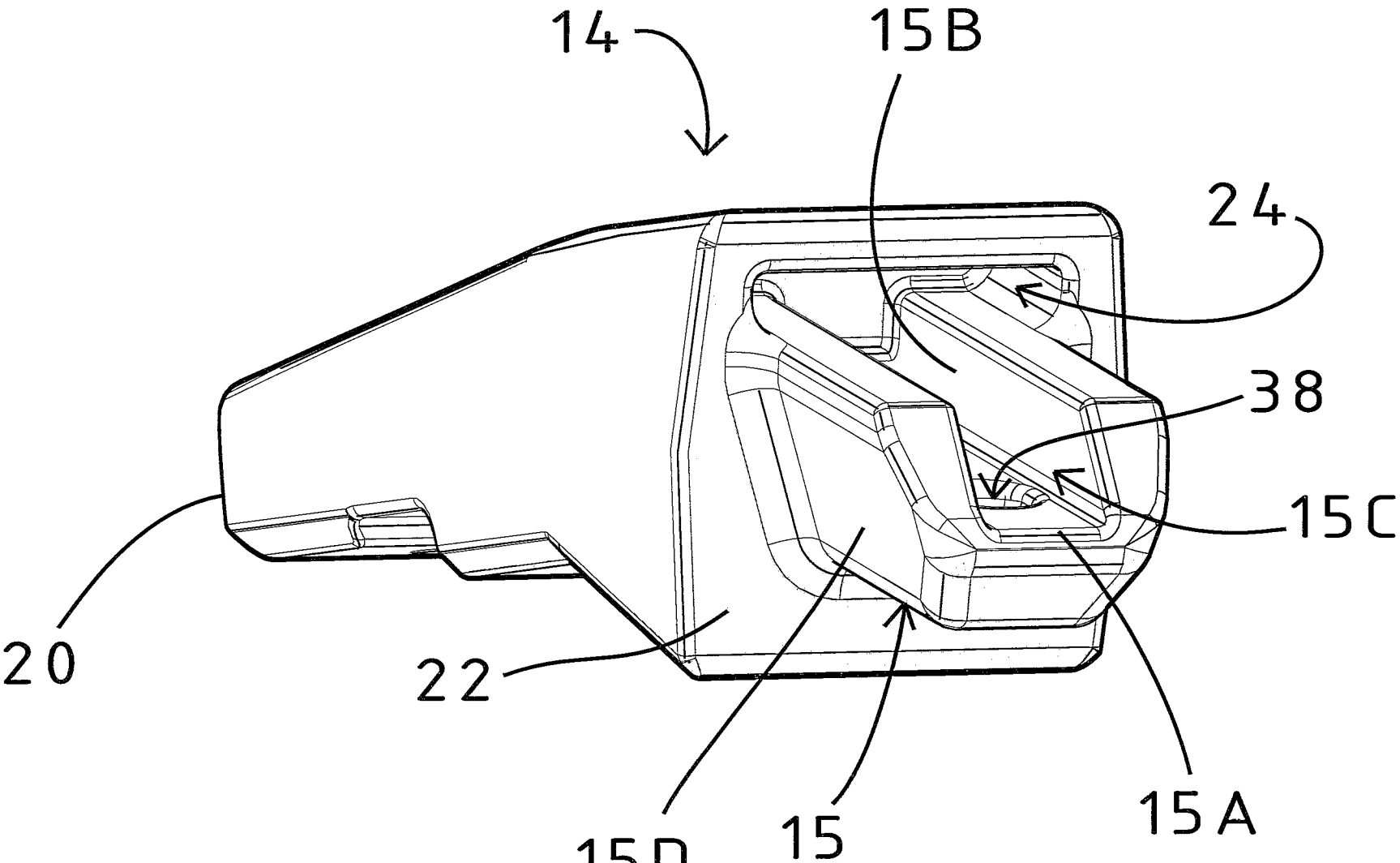
FIG. 5 is another perspective view of the adapter.

As shown in FIGS. 4 and 5, the adapter 14 has a first portion 20 which may be at or near one end of the adapter 14 and a second portion 22 which may be at or near another end of the adapter 14. The first portion 20 is adapted to be combined with an earth-digging implement. The adapter 14 may be combined with the implement by any suitable means, including by welding or by mechanical fasteners 34 such as bolts. In embodiments where the adapter 14 is combined to the implement by mechanical fasteners 34, the first portion 20 of the adapter 14 has openings 30 adapted to receive the mechanical fasteners 34. The arrows C in FIG. 2 show the fasteners 34 are selectively removable from the adapter 14. The second portion 22 is adapted to be combined with the tooth 12. The second portion 22 of the adapter 14 has an opening 24 adapted to receive an engagement member 13 extending from the second portion 28 of the tooth 12. The second portion 22 of the adapter 14 also has an engagement member 15 extending therefrom which is adapted to be received by an opening 18 in the tooth 12. As described below in more detail, the engagement member 15 extending from the adapter 14 may have an opening or channel 15C adapted to receive a portion of the tooth's engagement member 13. The channel 15C in the engagement member 15 is in addition to the opening 24 in the body of the adapter 14 so that both components (adapter 14 and engagement member 15) receive a portion of the tooth's engagement member 13.

Figure 6:
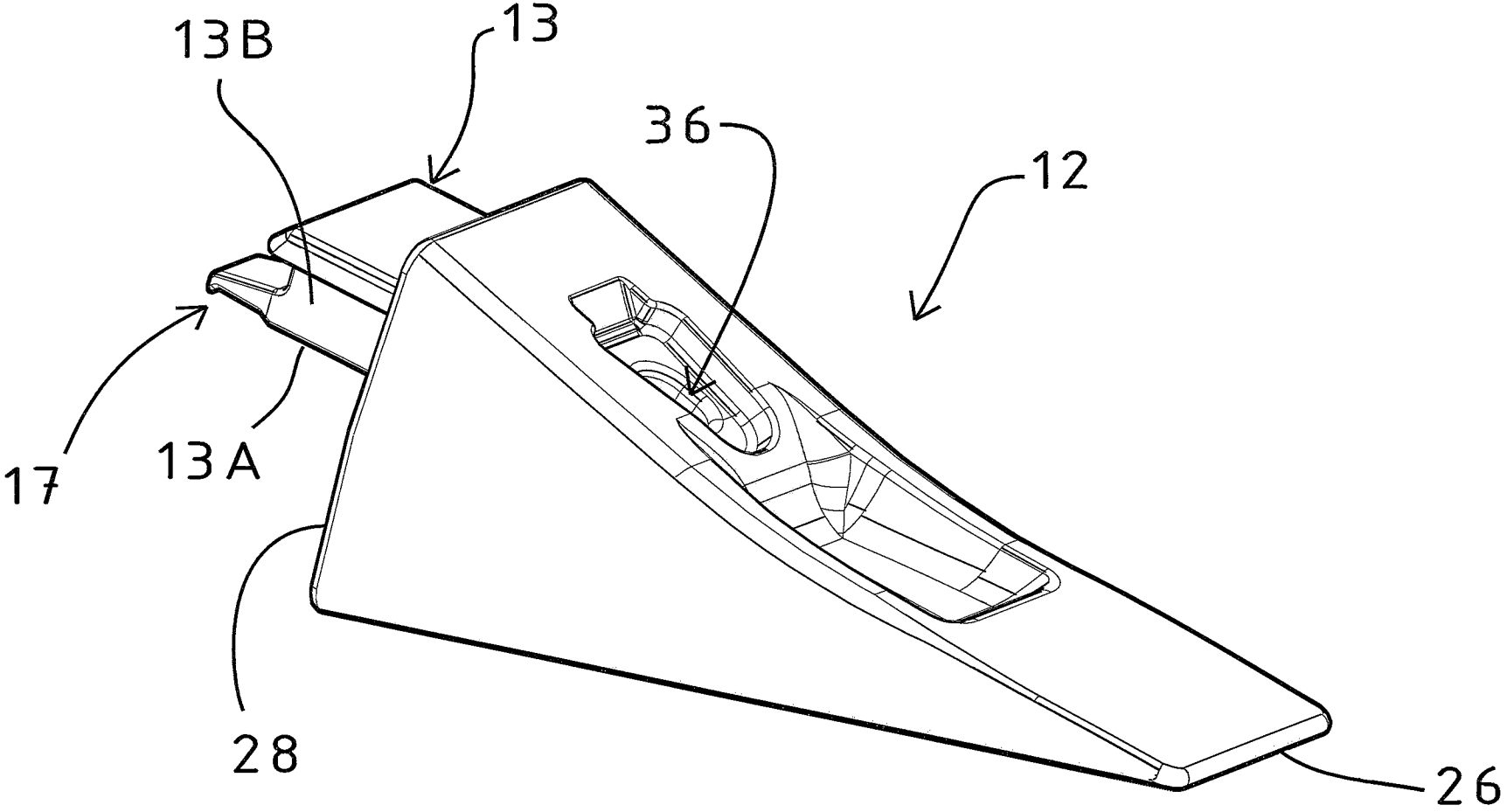
FIG. 6 is a perspective view of the tooth.
Figure 7:
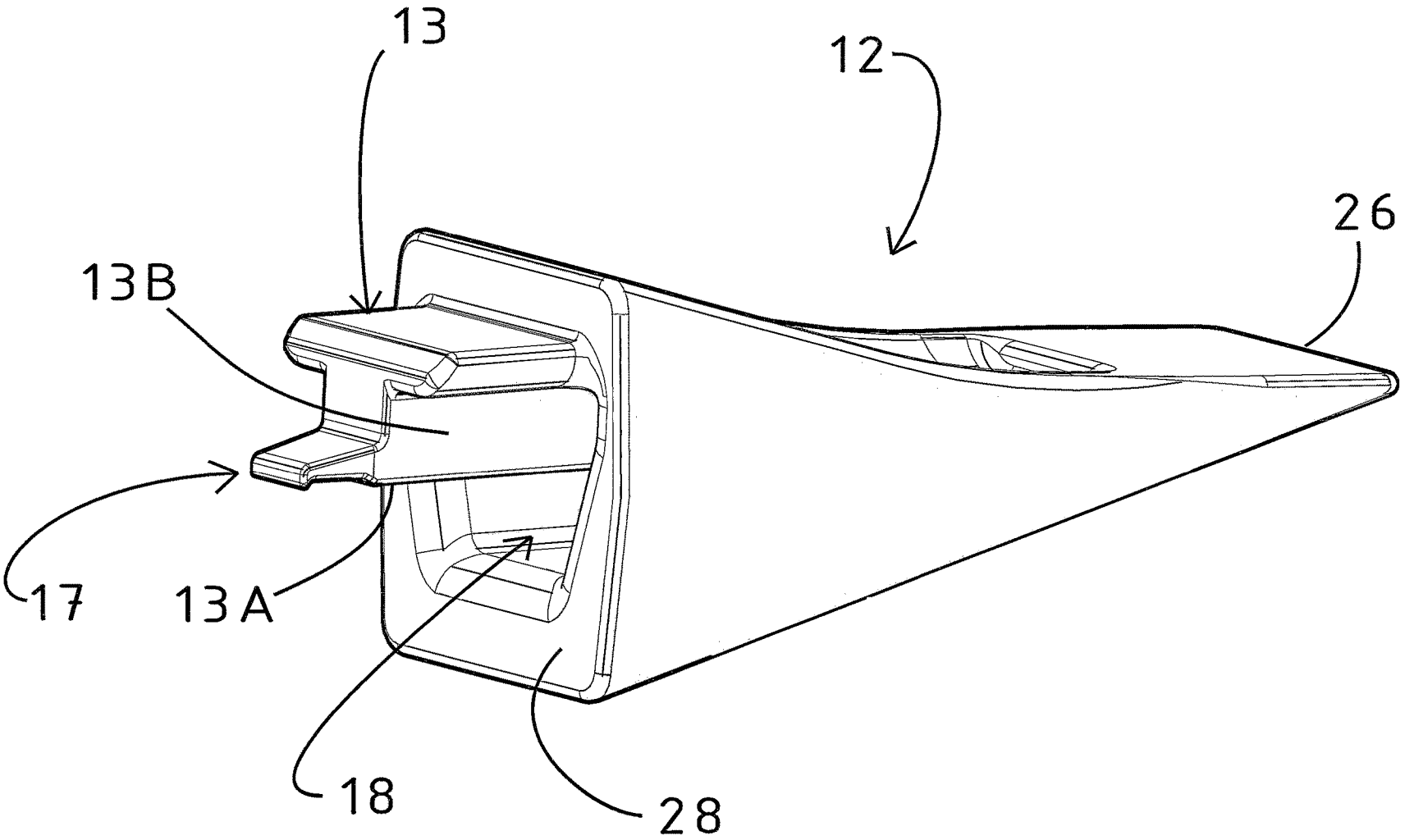
FIG. 7 is another perspective view of the tooth.

As shown in FIGS. 6 and 7, the tooth 12 has a first portion 26 which may be at or near one end of the tooth 12 and a second portion 28 which may be at or near another end of the tooth 12. The first portion 26 of the tooth 12 is adapted to engage the ground, rocks, dirt, and other material and the second portion 28 is adapted to be combined with the adapter 14. The second portion 28 of the tooth 12 has an opening 18 adapted to receive an engagement member 15 extending from the second portion 22 of the adapter 14. The second portion 28 of the tooth 12 also has an engagement member 13 extending therefrom adapted to be received by an opening 24 in the adapter 14.

As mentioned above, the second portion of each component (tooth 12 and adapter 14) includes a "male" engagement member 13, 15 adapted to be received by a corresponding opening 18, 24 (a "female" portion) in the second portion of the other component 12, 14. In this configuration, a portion of each component 12, 14 extends into an opening 18, 24 in the other component 12, 14 to help share the load and provide a tight fit between the components 12, 14. In some embodiments each engagement member 13, 15 has a first surface 13A, 15A extending in a first direction and a second surface 13B, 15B extending in a second direction. Each engagement member 13, 15 is received by the opening 18, 24 in the other component 12, 14 so that the surfaces 13A, 13B engage the corresponding second surfaces 15A, 15B in the other component 12, 14. The mating of the components 12, 14 along surfaces extending in two directions helps provide stability for the connection between the tooth 12 and the adapter 14 regardless of the direction of force applied to the tooth 12 during operation. In other words, the load is shared between the components 12, 14 regardless of the direction of force because the geometry of the engagement members 13, 15 overlaps. In some embodiments the first surfaces 13A, 15A extend in a generally horizontal direction and the second surfaces 13B, 15B extend in a generally vertical direction. In some embodiments the two first surfaces 13A, 15A are generally perpendicular to the two second surfaces 13B, 15B. In some embodiments the first surfaces 13A, 15A and the second surfaces 13B, 15B are flat.

As mentioned above, in some embodiments the adapter's engagement member 15 includes a channel 15C along its longitudinal axis in addition to the opening 24 within the body of the adapter 14. The channel 15C may be an elongated opening or groove. As shown in FIG. 5, the channel 15C extends along the entire length of the adapter's engagement member 15. The channel 15C has a first width and the tooth's engagement member 13 has a second width. The first width is larger than the second width so the tooth's engagement member 13 is received by the channel 15C in adapter's engagement member 15. In some embodiments the channel 15C has two opposing inner walls 15B extending along the longitudinal axis. The two inner walls 15B are connected by a third wall 15A. The adapter's engagement member 15 also has outer walls 15D. In this embodiment the tooth's engagement member 13 engages the inner walls 15B of the channel 15C and the outer walls 15D of the engagement member 15 engage the interior surface of the tooth 12. This provides additional strength and stability for the connection between components 12, 14. Some embodiments may include a fourth wall (not shown) opposing the third wall 15A so the channel 15C is an opening having walls on all sides. Further, in some embodiments one or more of the walls 15A, 15B of the channel may be rounded instead of flat (not shown).

In some embodiments the tooth's engagement member 13 has two intersecting members or walls. In some embodiments the intersecting members are in the shape of an "X" or a "T" as shown in FIG. 7. A first portion of the tooth's engagement member 13 is received by a correspondingly shaped channel 15C in the adapter's engagement member 15 and a second portion of the tooth's engagement member 13 is received by the opening 24 in the adapter 14 but not by the adapter's engagement member 15. The channel 15C is wider than a portion of the tooth's engagement member 13 so that the tooth's engagement member 13 extends into and is surrounded by the channel 15C on at least three sides with at least two of the sides extending at intersecting angles to provide rigidity and strength in at least two dimensions. In this embodiment the tooth's engagement member 13 engages the internal walls 15B of the channel 15C and the outer walls 15D engage the inside of the tooth 12. This provides additional strength and stability for the connection between components 12, 14. In some embodiments the adapter's engagement member 15 is generally "L", "C", "U", or "V" shaped with the channel 15C through the open portion of the geometry.

The description of engagement member 13, 15 geometries in the previous paragraphs and elsewhere in this specification are shown with reference to FIGS. 4-7, however, the geometries could be reversed such that the engagement member having the channel 15C extends from the tooth 12 and is received by the adapter 14 and the other engagement member extends from the adapter 14 and is received by the tooth 12.

Figure 8:
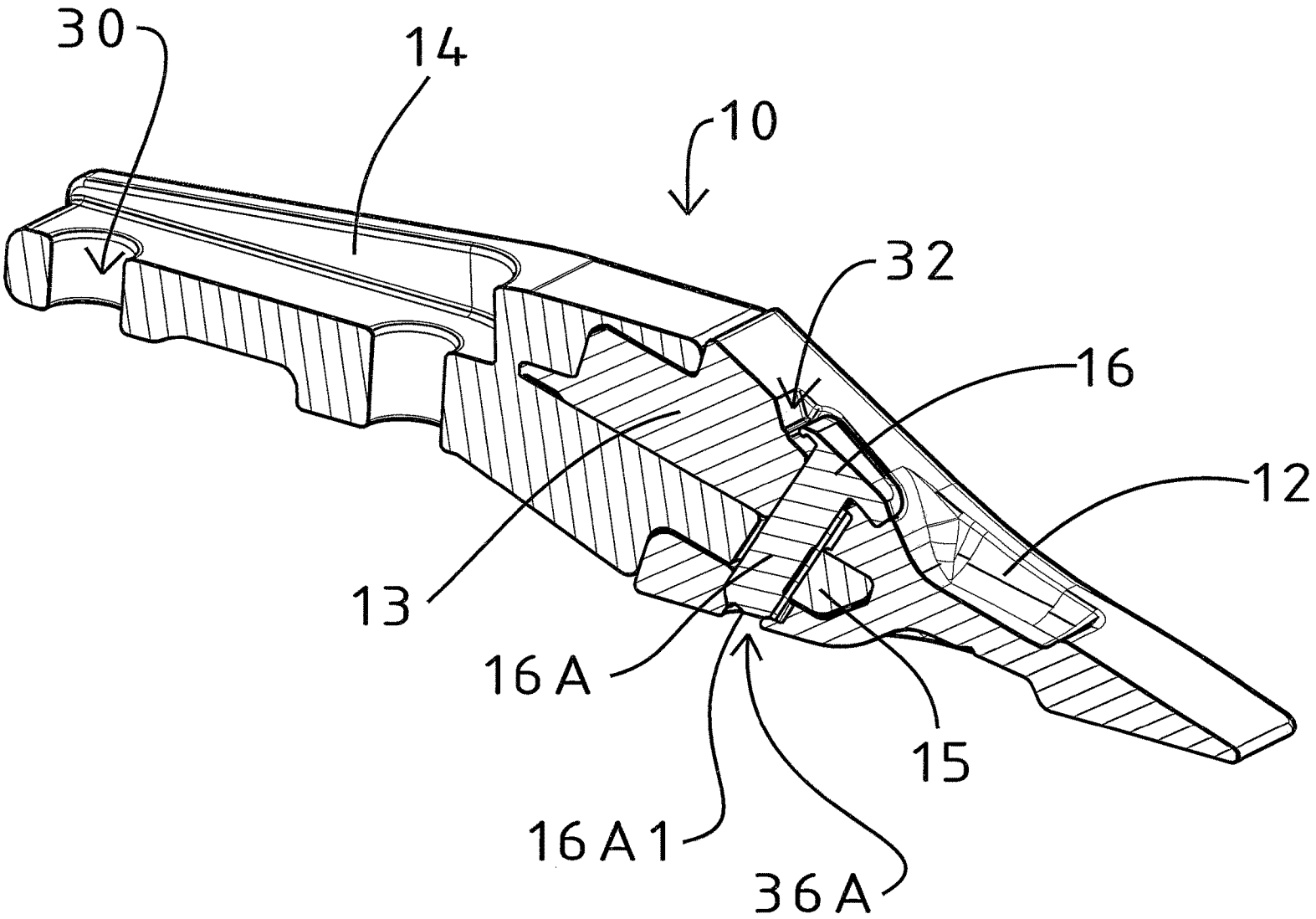
FIG. 8 is a section view of the tooth assembly taken along line A-A shown in FIG. 3.
Figure 9:
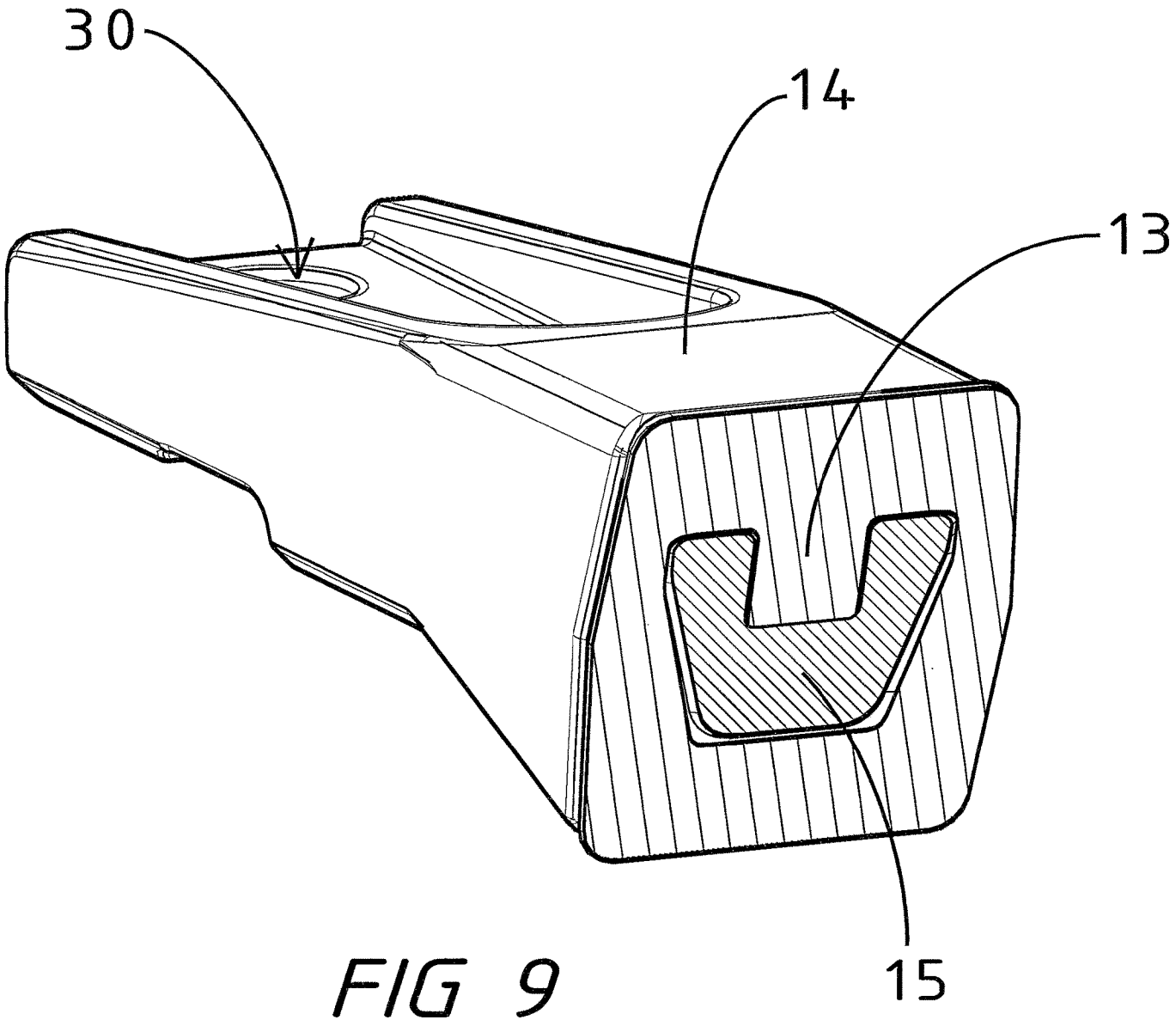
FIG. 9 is a section view of the tooth assembly taken along line B-B shown in FIG. 3.

FIGS. 8 and 9 show section views of the tooth assembly 10 wherein a portion of each component (adapter 14 and tooth 12) extends into the opening 18, 24 in the other component 12, 14 to help provide stability to the attachment regardless of the direction of force being applied to the tooth 12. As shown in FIG. 8, the adapter's engagement member 15 extends into the tooth's opening 18. As shown in FIG. 9, the tooth's engagement member 13 extends into the channel 15C.

Figure 10A:
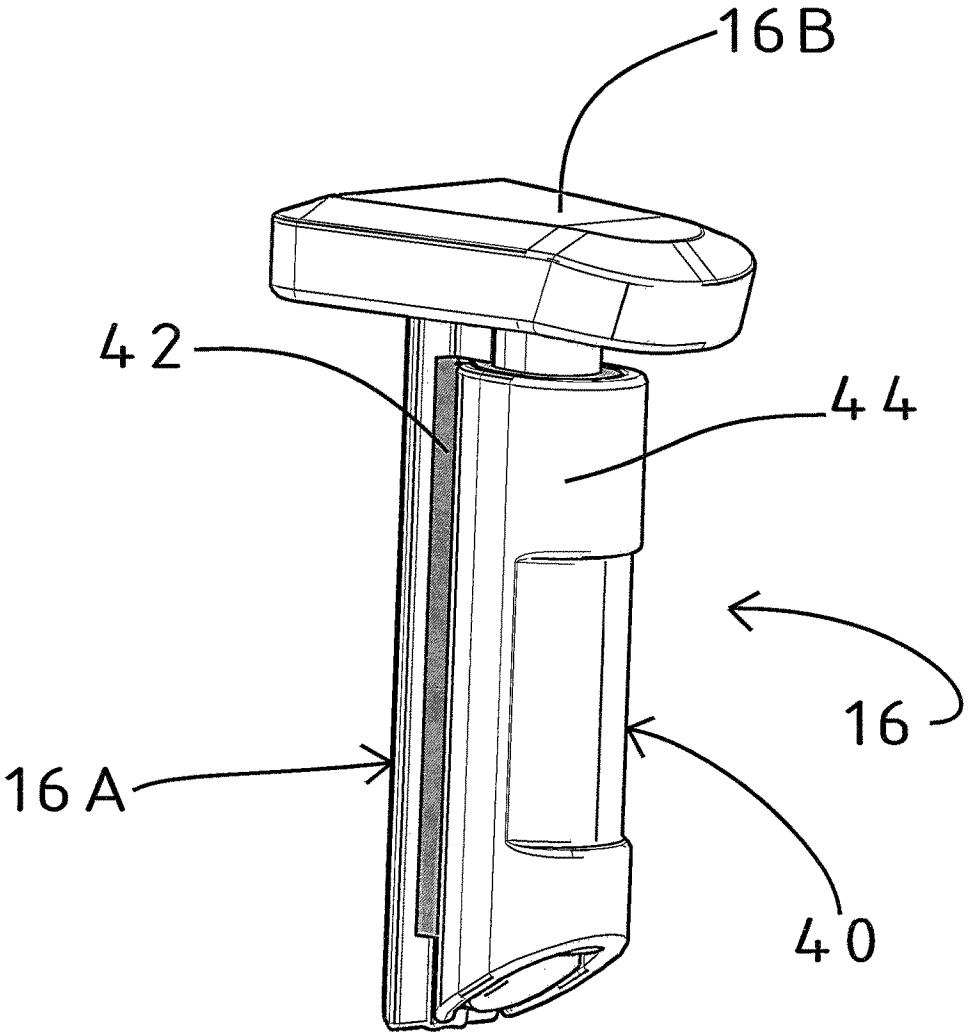
FIG. 10A is a perspective view of the pin.

FIGS. 10A-10D show the pin 16 and its components and features. FIG. 10A shows the pin 16 having a shaft 16A extending in a longitudinal direction away from a pin head 16B. FIG. 8 shows the pin 16 in its seated portion inserted through apertures 36, 38 in the tooth 12 and adapter 14, respectively, to secure the two components 12, 14 together. In some embodiments the aperture 36 is in a top surface of the tooth 12. In these embodiments the pin 16 is inserted downward through the top surface of the tooth 12 so the longitudinal axis of the aperture 36 (and correspondingly, shaft 16A of the pin 16 when the assembly is in its assembled configuration) is generally perpendicular to the top digging surface of the tooth 12. This allows the pin 16 to be easily removed even in situations where a plurality of tooth assemblies 10 are positioned very close to each other (side-by-side). In some embodiments the pin head 16B has an asymmetrical shape such as a triangle or arrow. FIG. 6 shows the top surface of the tooth 12 with the pin 16 removed. The top surface of the tooth 12 has a recesses which matches the asymmetrical shape of the pin head 16B to help the user align the pin 16 in the proper orientation.

Figure 10B:
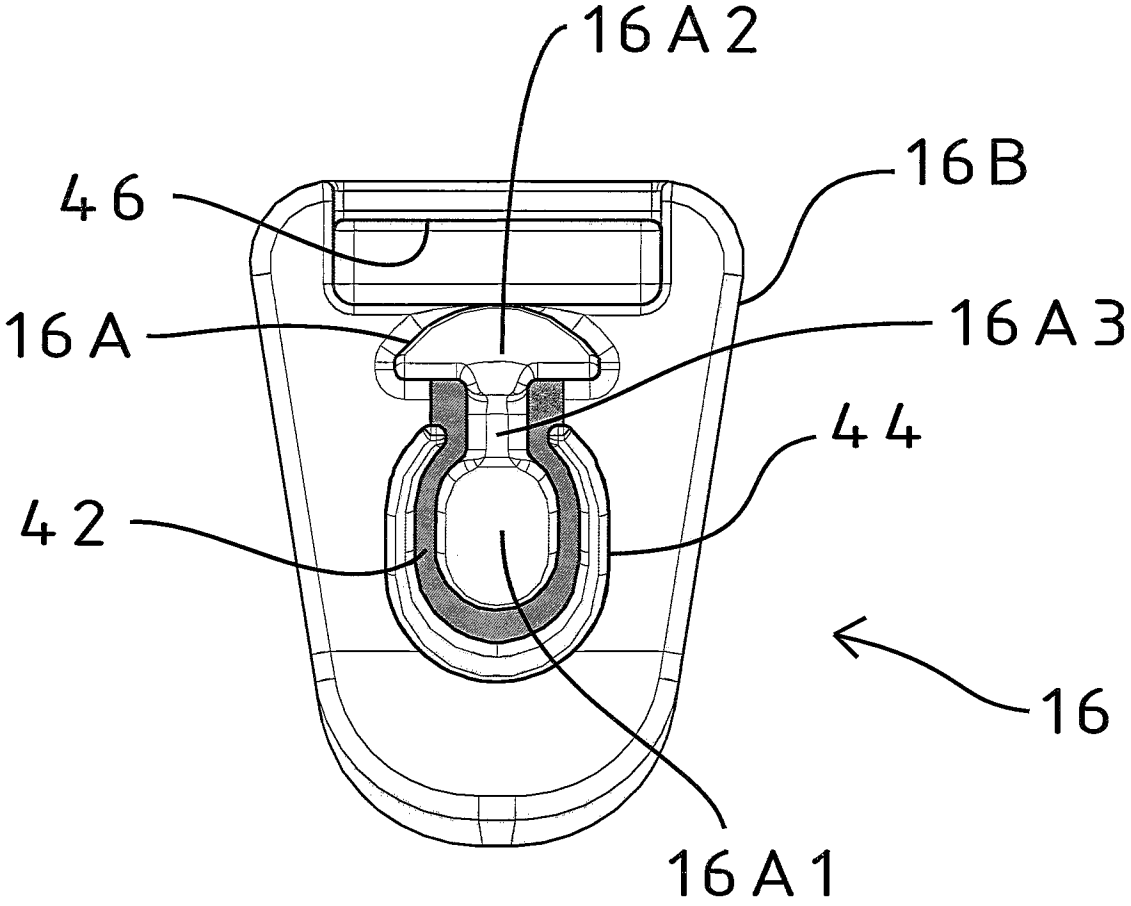
FIG. 10B is a bottom view of the pin.
Figure 10C:
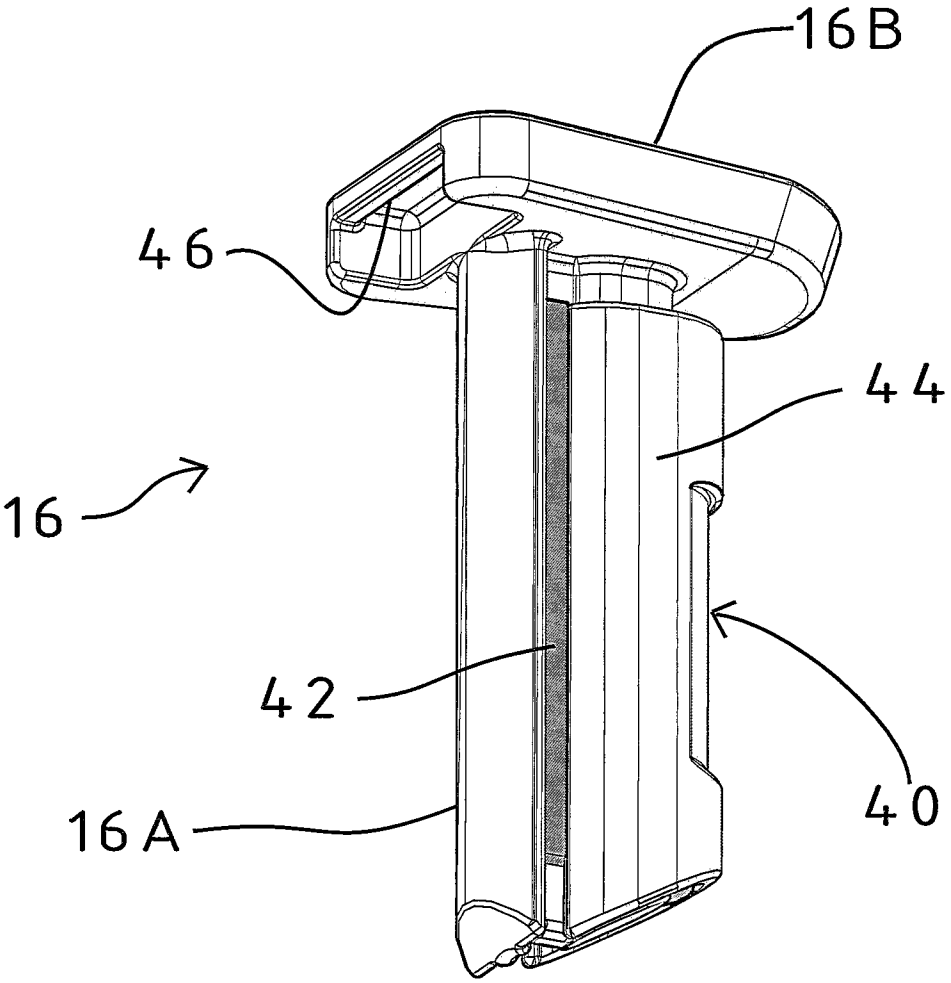
FIG. 10C is another perspective view of the pin.
Figure 10D:
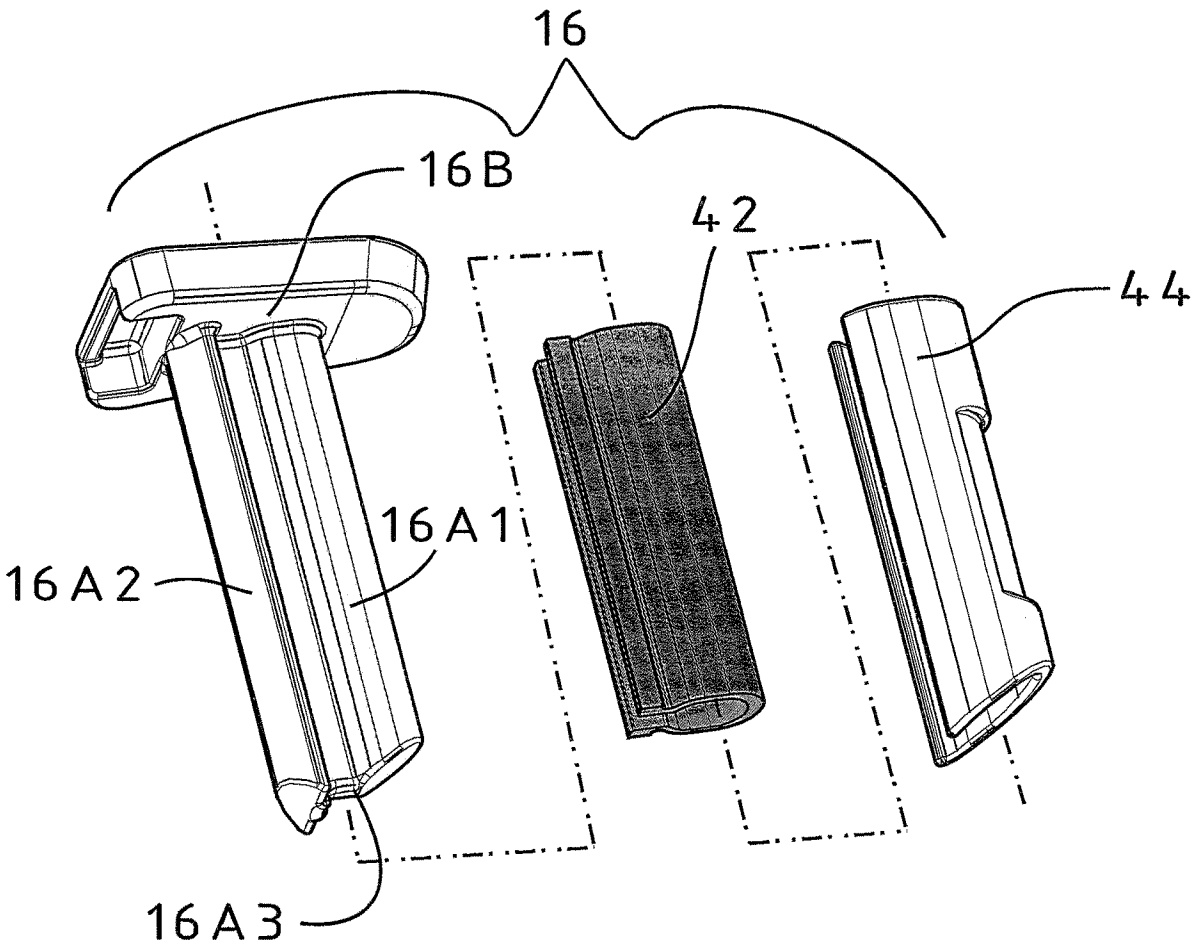
FIG. 10D is an exploded view of the pin.

FIGS. 10B, 10C, and 10D show additional features of some embodiments of the pin 16. The pin 16 may have a compression member 44 attached to the shaft 16A by a compressible material 42 such as volcanized rubber. The compression member 44 may be made of metal, plastic, or any other suitable material. The compression member 44 has a first position wherein it extends a first distance from the shaft 16A and a second (compressed) position wherein it extends a second distance from the shaft 16A, wherein the first distance is greater than the second distance. The compression member 44 includes a recessed portion 40 adapted to engage a locking member inside the assembly to help hold the pin in place during operation. As shown in FIG. 8, in one embodiment the locking member is the engagement member 15 extending from the second portion 22 of the adapter 14. In this embodiment the recessed portion 40 has a length that is generally the same length as the inner wall of the opening 38 in the engagement member 15 of the adapter 14. The recessed portion 40 serves as a detent to secure the pin 16 in place against the locking member during normal working conditions. Applying force to the pin 16 causes the compression member 44 to move to its second (compressed)

position thereby allowing the recessed portion 40 to slide past the locking member so the pin 16 can be removed from its seat within the assembly 10.

As shown in FIGS. 10B and 10D, the shaft 16A of the pin 16 may comprise two separate longitudinal members 16A1 and 16A2 extending generally parallel to each other. The longitudinal members 16A1 and 16A2 are connected by an intermediate member 16A3 having a width that is smaller than a width of the first longitudinal member 16A1. The compressible material 42 surrounds the first longitudinal member 16A1 and is also combined with a surface of the second longitudinal member 16A2. The compression member 44 is combined with and generally surrounds the compressible material 42 so that the compressible material 42 is between the first longitudinal member 16A1 and the compression member 44. The compression member 44 may be "C" or horseshoe shaped so that its ends 46 are a predetermined distance apart. This predetermined distance is smaller than the width or diameter of the first longitudinal member 16A1 to help prevent the compression member 44 from becoming removed from the first longitudinal member 16A1.

FIG. 8 shows the shaft 16A of the pin 16 generally aligned with the aperture opening 36A in the bottom of the assembly 10. Having the relatively sturdy shaft 16A of the pin 16 align with the bottom aperture opening 36A is beneficial because it provides a solid structure to hit or push when removing the pin 16 using a nail or punch to push the pin 16 out of its seat. In one embodiment, the portion of the shaft 16A which aligns with the aperture opening 36A in the bottom of the assembly 10 is the first longitudinal member 16A1. As shown in FIG. 10D, the bottom surface of the first longitudinal member 16A1 is angled at generally the same angle that the pin 16 is inserted into the assembly so the exposed portion of the bottom surface of the first longitudinal member 16A1 is generally parallel with the bottom surface of the tooth 12.

Figure 11A:
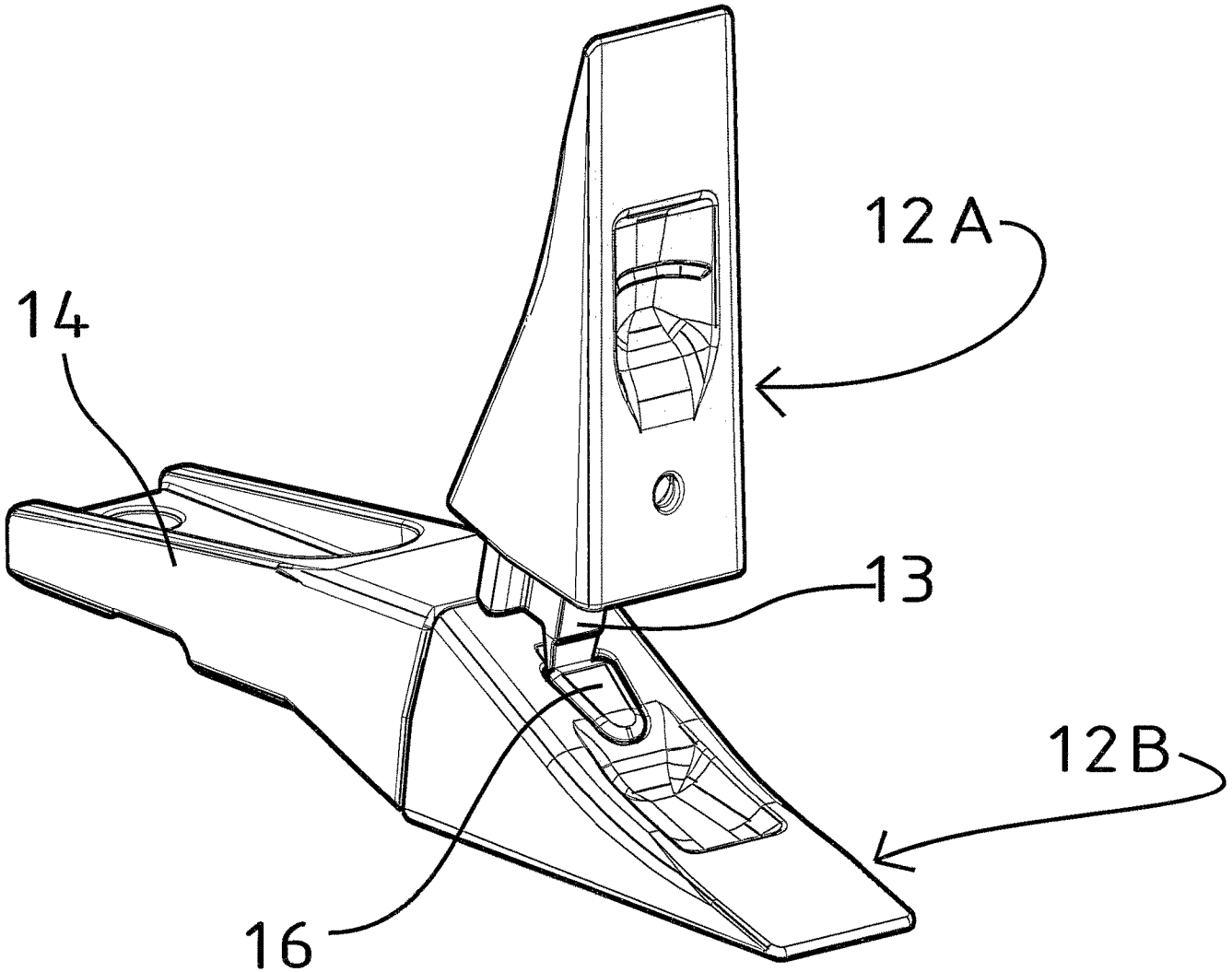
FIG. 11A is a perspective view showing the pry bar of a first tooth engaging the lip of the pin.
Figure 11B:
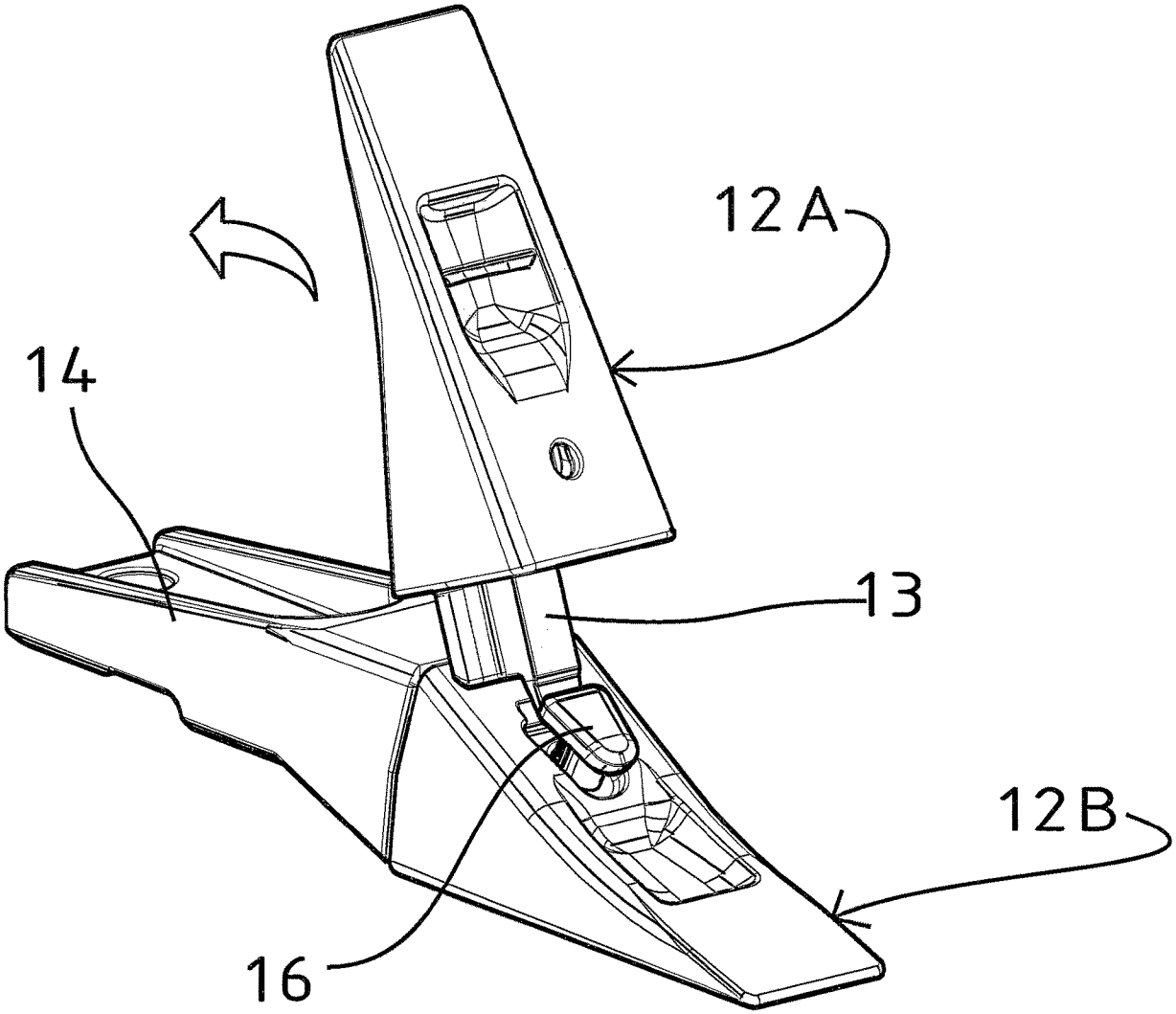
FIG. 11B is a perspective view similar to FIG. 10A but showing the pry bar of the first tooth pulling the pin from its seat in the second (existing) tooth.
Figure 11C:
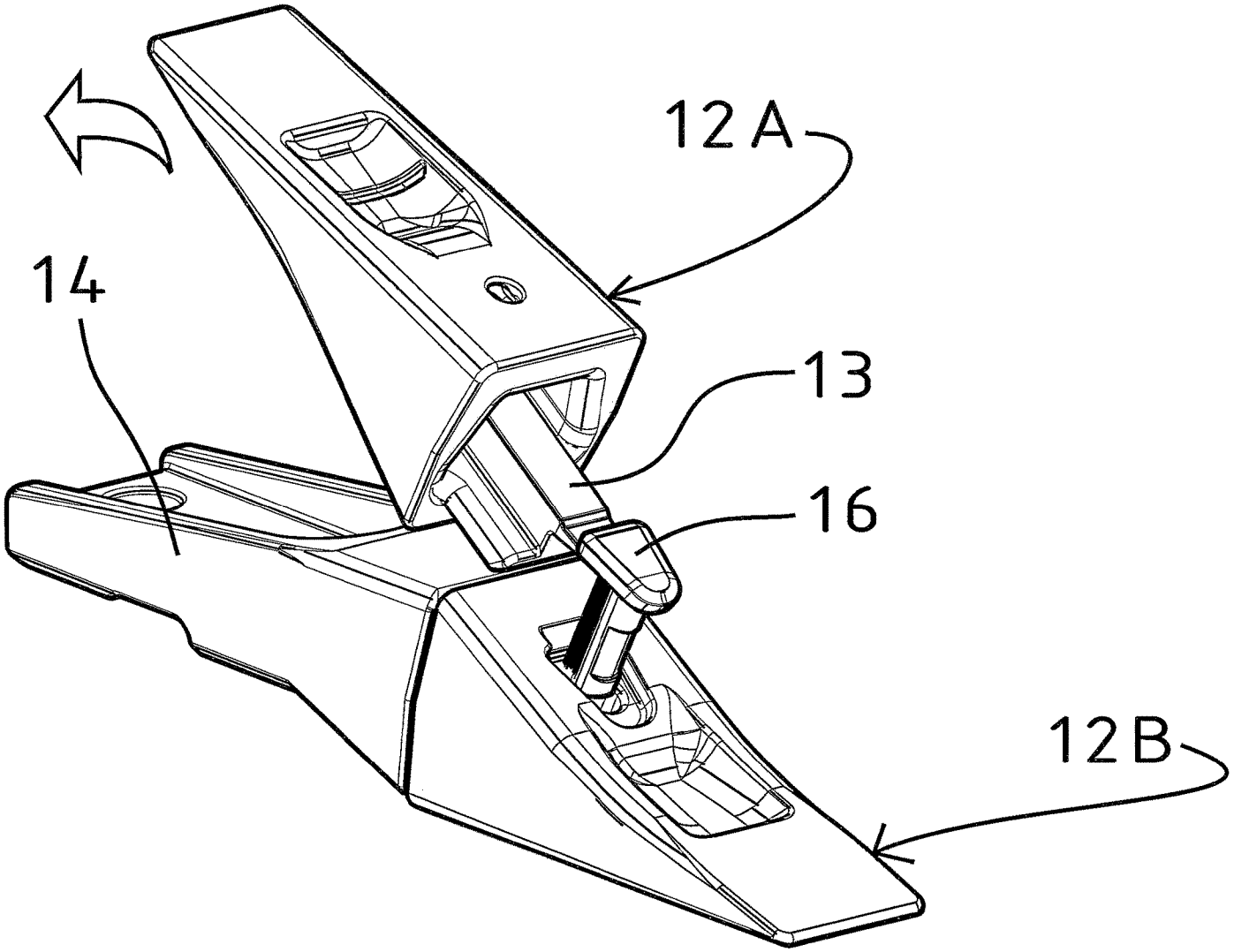
FIG. 11C is a perspective view similar to FIG. 10B but showing the pry bar of the first tooth further pulling the pin from its seat in the second (existing) tooth.

FIGS. 11A, 11B, and 11C illustrate a feature of one embodiment wherein a first tooth 12A may be used as a pry bar to pull the pin 16 from its seat in a second tooth 12B. In this embodiment, the engagement member 13 extending from the second portion 28 of the first tooth 12A has a head 17 on its end which may be a blade. The head 17 may be flat and may have a profile similar to a flat-blade screwdriver. In some embodiments the head 17 may be tapered so its width gets smaller toward its distal end as best shown in FIGS. 6 and 7. In some embodiments the head 17 may have a curved lip or a curved chisel portion near its distal end to help provide a fulcrum for leverage as best shown in FIGS. 6 and 7. As shown best in FIGS. 6 and 8, the tooth 12 may have a recessed portion 32 larger than the pin head 16B. FIG. 11A shows the head 17 of the engagement member 13 placed under the pin head 16B at the area where the recessed portion 32 in the second tooth 12B is larger than the pin head 16B. FIG. 11B shows the first tooth 12A being pressed downward in the direction of the arrow to begin to pry the pin 16 from its seat. FIG. 11C shows the continued movement of the first tooth 12A in the direction of the arrow to lift the pin 16 out from its seat so the second tooth 12B can be separated from the adapter 14. In this manner, the first tooth 12A, second tooth 12B, adapter 14 and pin 16 form a kit. The first tooth 12A is a new/replacement tooth for the assembly and the second tooth 12B is the old/worn tooth. The new tooth 12A can be used as the tool to remove the old tooth 12B from the assembly so that no additional tools are required for the removal and replacement of a tooth 12. It should be noted that a pry bar, screw driver, or other device may also be used to remove the pin 16 from its seat within the assembly 10. Therefore, the pin 16 may be removed by any of the three ways described herein: pushing it out using a punch through the bottom aperture opening 36A, prying it out from the top using a new tooth 12B, or prying it out from the top using a pry bar, screw driver, or other similar device.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is:

1. A tooth assembly for attachment to an implement, said tooth assembly comprising:

an adapter having a first portion and a second portion, the first portion of the adapter is configured to be combined with the implement and the second portion of the adapter has an opening and an engagement member extending therefrom;

a tooth having a first portion and a second portion, the first portion of the tooth is configured to engage material being displaced by the implement and the second portion of the tooth has an opening and an engagement member extending therefrom;

wherein the opening in the second end of the adapter is configured to receive the engagement member extending from the tooth;

wherein the opening in the second end of the tooth is configured to receive the engagement member extending from the adapter; and a pin having a pin head combined with a shaft, wherein the pin is configured to extend through an aperture in the adapter and an aperture in the tooth to secure the adapter and the tooth in an assembled configuration.

2. The tooth assembly of claim 1 wherein the tooth has a top surface and the aperture in the tooth is generally perpendicular to the top surface of the tooth.

3. The tooth assembly of claim 1 wherein the tooth has a top surface and a recessed portion in the top surface around the aperture in the tooth.

4. The tooth assembly of claim 3 wherein the recessed portion has an asymmetrical shape and the pin head has a corresponding asymmetrical shape so as to be received by the recessed portion.

5. The tooth assembly of claim 1 wherein the engagement member extending from the tooth is generally "T" shaped.

6. The tooth assembly of claim 1 wherein the engagement member extending from the tooth has a distal end; and wherein the engagement member extending from the tooth has a head at its distal end.

7. The tooth assembly of claim 6 wherein the head is a blade that tapers to become narrower at the distal end.

8. The tooth assembly of claim 6 wherein the head has a curved lip at the distal end.

9. The tooth assembly of claim 1 wherein the opening in the adapter has at least one wall with a height, a width, and a depth.

10. The tooth assembly of claim 1 wherein the opening in the tooth has at least one wall with a height, a width, and a depth.

11. A tooth assembly for attachment to an implement, said tooth assembly comprising:

an adapter having a first portion and a second portion, the first portion of the adapter is configured to be combined with the implement and the second portion of the adapter has an opening and an engagement member extending therefrom;

a tooth having a first portion and a second portion, the first portion of the tooth is configured to engage material being displaced by the implement and the second portion of the tooth has an opening and an engagement member extending therefrom;

wherein the opening in the second end of the adapter is configured to receive the engagement member extending from the tooth;

wherein the opening in the second end of the tooth is configured to receive the engagement member extending from the adapter; and a pin having a pin head combined with a shaft, wherein the pin is configured to extend through an aperture in the adapter and an aperture in the tooth to secure the adapter and the tooth in an assembled configuration;

wherein one of the engagement member extending from the adapter and the engagement member extending from the tooth includes a channel configured to receive a portion of the other engagement member.

12. The tooth assembly of claim 11, wherein the engagement member extending from the tooth has a first surface extending in a first direction and a second surface extending in a second direction and the engagement member extending from the adapter has a first surface extending in a first direction and a second surface extending in a second direction; and wherein in the assembled configuration the two first surfaces engage each other and the two second surfaces engage each other.

13. The tooth assembly of claim 12 wherein the two first surfaces are generally perpendicular to the two second surfaces.

14. The tooth assembly of claim 12 wherein the two first surfaces are flat and the two second surfaces are flat.

* * * * *